United States Patent [19]

Fox et al.

[11] 4,402,430

[45] Sep. 6, 1983

[54] MECHANISM FOR DISPENSING CHEMICALS FROM A PRESSURIZED CONTAINER

[75] Inventors: Mitchell Fox, Altamonte Springs, Fla.; Alfred F. Washburn, 1448 Lakeshore Dr., Mount Dora, Fla. 32757

[73] Assignee: Alfred F. Washburn, Mount Dora, Fla.

[21] Appl. No.: 192,339

[22] Filed: Sep. 29, 1980

[51] Int. Cl.[3] ..... F41H 9/00

[52] U.S. Cl. ..... 222/183; 222/325; 222/509; 42/1 G

[58] Field of Search ..... 222/162, 325, 402.15, 222/509, 183; 42/1 G; 169/76, 88

[56] References Cited

U.S. PATENT DOCUMENTS

| | | | |
|---|---|---|---|
| 3,028,055 | 4/1962 | Wood | 222/509 X |
| 3,247,655 | 4/1966 | Jacob | 222/162 X |
| 3,534,889 | 10/1970 | O'Donnell | 222/509 X |
| 4,223,804 | 9/1980 | Morris et al. | 222/3 |

FOREIGN PATENT DOCUMENTS

| | | | |
|---|---|---|---|
| 1915045 | 10/1970 | Fed. Rep. of Germany | 42/1 G |

*Primary Examiner*—Joseph J. Rolla
*Assistant Examiner*—Frederick R. Handren
*Attorney, Agent, or Firm*—Duckworth, Allen, Dyer & Pettis

[57] ABSTRACT

A hand-held holder for pressurized chemical cartridges includes a casing having an opening therethrough between first and second ends and a cartridge-carrying frame member dimensioned to slide through the opening. A valve at the first end of the frame member is adapted to engage the cartridge for dispensing the chemical therein, and a lever pivoted at the second end of the casing holds the cartridge in a relatively fixed position while driving the frame through the casing toward the rearward, second end of the casing to cause movement of the valve toward and into engagement with the cartridge to effect the dispensing of the pressurized chemical contained in the cartridge.

12 Claims, 9 Drawing Figures

MECHANISM FOR DISPENSING CHEMICALS FROM A PRESSURIZED CONTAINER

BACKGROUND OF THE INVENTION

Heretofore deterrent chemical containing aerosol cans have been supplied with movably connected pressure release caps incorporating finger tabs by which said valve actuator cap may be moved against the pressure release valve of the hand held cartridge with the required force to release the chemical spray outwardly of said unit. This method of procedure does not lend itself to the greatest measure of facility when used independently and much less so when attachment is attempted to other objects, for the purpose of unified operation with one hand. Accidental discharge is prevented by relocating the valve actuator cap on the opposite or non-valve end of the cartridge. In order to arm in preparation for action the valve cap must be transferred back onto the valve end of the cartridge, an operation which cannot be feasibly accomplished with one hand.

In the past flashlights have been designed integrally incorporating pressurized chemical containers with mechanisms so arranged that the discharge is dispersed in the rays of light of the flashlight by triggering means mounted on the exterior of the flashlight. However, in many situations it is desirable that the chemical dispensing unit with its triggering mechanism be detachable from the flashlight for independent use when illumination is unnecessary, where carrying space is limited, or for use with an attachment means in conjunction with other objects.

SUMMARY OF THE INVENTION

This invention relates to a hand held unit for dispensing discharge from a pressurized cartridge containing chemicals of the non-lethal type used to temporarily immobilize an attacker without permanent injury, and more particularly to the nature of the dispensing mechanism in providing facility of one hand operation, security against accidental discharge, and ease of replacement of the cartridge. The method of activating the dispensing valve of the pressurized container is such that said device may be independently used where facility of a one handed operation of an instantly operational device is desired or when the device may be utilized by detachably securing means in conjunction with other compatible units such as flashlights, carrying cases, walking sticks, or other personally carried units. A further purpose of the invention is to provide a device in accordance with the preceding objects which will conform to conventional forms of manufacture, be of simple construction, and easy to use and reload so as to provide a device that will be economically feasible, long lasting, and relatively trouble free in operation and handling.

The proposed unit to comprise in combination: a holder having a casing, a longitudinally movable frame within said casing for retaining a pressurized chemical cartridge, an axle borne cam with operating lever extension swinging in a plane at right angle to the axle and parallel to the long axis of the holder, a notch so located in said cam to engage a spring secured to the cartridge carrier frame to translate rotary motion of the cam into a rearward movement of the frame, a vertical flat spring secured to the cartridge carrier frame to bear against the rear periphery of the cam to restrain movement of the frame within operational tolerance limitations at all times except when the cam is rotated upward out of contact with spring in order that the carrying frame be freed for removal through the front of the housing. The rear surface of the cam to be so shaped that when in the inoperative safety position it will restrain accidental movement of said cam out of this position into the operating position.

BRIEF DESCRIPTION OF THE DRAWINGS

Other features, objects, and advantages of the present invention will be apparent from the written description and drawings. Referring now to the drawings.

FIG. 4 also shows cam 3 with notches 16 and 17 and operating lever 2.

OPERATION DESCRIBED WITH RELATION TO THE DRAWINGS

Figure 1:
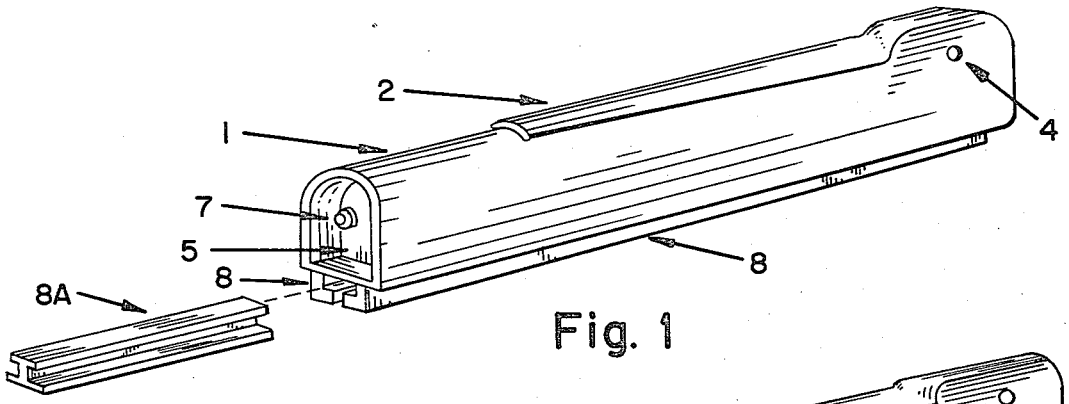
FIG. 1 illustrates the Mechanism for Dispensing Chemicals from a Pressurized Container. The housing 1 is shown with the cam operating handle extension 2 lying parallel to housing 1 in the inactive safety position pivoted on axle 4. The forward end of the cartridge carrying frame 5 may be seen with its discharge nozzle 7 within housing 1. Attachment means 8 with companion mating means 8A is also shown in FIG. 1.
Figure 2:
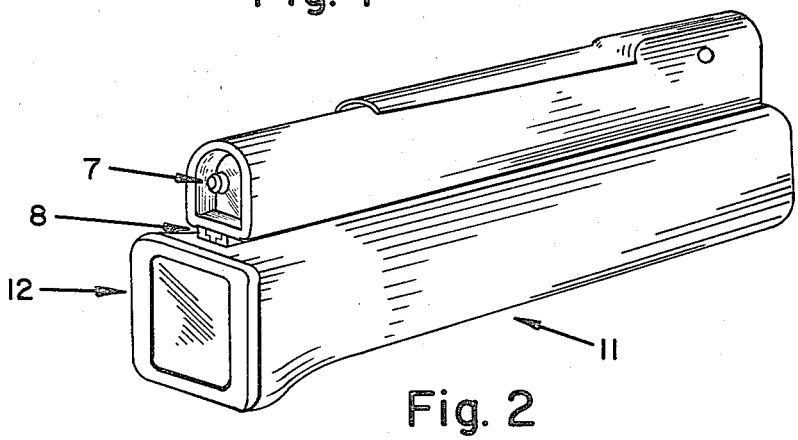
FIG. 2 shows the Mechanism for Dispensing Chemicals from a pressurized Container attached to a flashlight 11 by attachment mating means 8 and 8A with discharge nozzle 7 facing forward to dispense chemicals from the pressurized cartridge into the rays of light from the bulb and reflector end of the flashlight 11.

Actual discharge of the chemical from the container FIG. 1 to be effected by a discharge nozzle 7 mounted forward on the cartridge frame 5 in such alignment to contact and activate the release valve of the container 6 to discharge at least a part of the fluid under pressure outwardly of said unit in response to rearward movement of the frame 5. The movement of the frame to be caused by partial rotation of the cam 3 on its axle 4 through movement of the operating handle 2. Said operating cam is suitably notched at 16 to receive the end of a flat spring 9 secured to and parallel to the cartridge carrying frame 5. Said notch being so located 16 on the periphery of the cam 3 that the spring 9 cannot enter the notch 16 until the cam 3 rotates as the operating handle 2 is raised from the inactive safety position to the ready to discharge position. From this position a downward movement of the cam handle 2 towards the housing 1 will bring the notch 16 into engagement with the cartridge carrier pushing spring 9 so that further pivoting of the cam 3 will be transferred through the spring 9 to a rearward movement of the frame 5. The forward profile of the cam 3 while in the operating position being a constant radius from its pivot 4 restrains the cartridge 6 whose rear or non-valve end bears against it from rearward movement while the frame 5 moves the discharge nozzle 7 against the valve contact 7 of said stationary cartridge to dispense the desired spray of chemical forward through the nozzle 7.

The cam operating lever 2 is returned to the inoperative safety position by releasing the lever and pushing the cartridge frame 5 forward so that the cam notch 16 swings forward and upward allowing the spring 9 to pass forward and under the notch permitting cam and lever to return to the inoperative position. Raising the cam lever and swinging 180 degrees to the rear rotates the cam free of the cartridge frame 5 and its vertical spring 10 allowing the frame to be released forward and out of the housing 1 for replacement of the cartridge 6.

1. Cam lever 2 lying parallel to housing 1 in the inoperative safety position, cartridge carrier frame pusher spring 9 is out of engagement with cam notch 16 and vertical spring 10 bears against the rear of the cam to restrain accidental upward movement of the operating lever.

2. Cam lever 2 raised for action and rotating cam 3 allowing cartridge carrier frame pusher spring 9 to engage cam notch 16.

3. Cam operating lever 2 moved downwards toward housing causing cam to pivot on bearing pin 4 to push spring 9 and cartridge carrier frame 5 to which it is attached rearward, forcing front of frame 5 and valve release nozzle 7 against cartridge valve while cartridge is restrained from rearward movement against front profile of the cam.

4. Cam lever moved upward causing cam to release cartridge carrier pusher spring when cartridge carrier frame is pushed from rear. Pusher spring 9 will now be too far forward to engage cam notch 16 which allows cam to rotate rearward returning operating lever back to the inoperative safety position.

Figure 3:
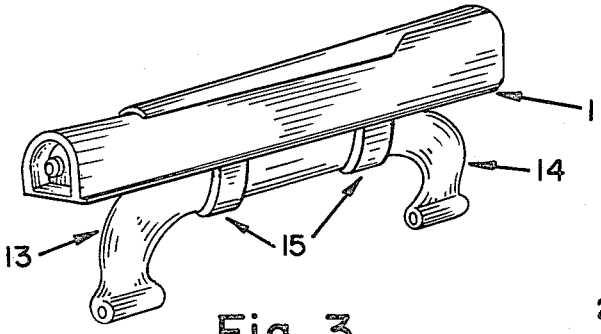
FIG. 3 illustrates the manner in which the housing or casing 1 may be attached to another type of disparate article, for example, a carrying handle 14, by means of fixtures 15.
Figure 4:
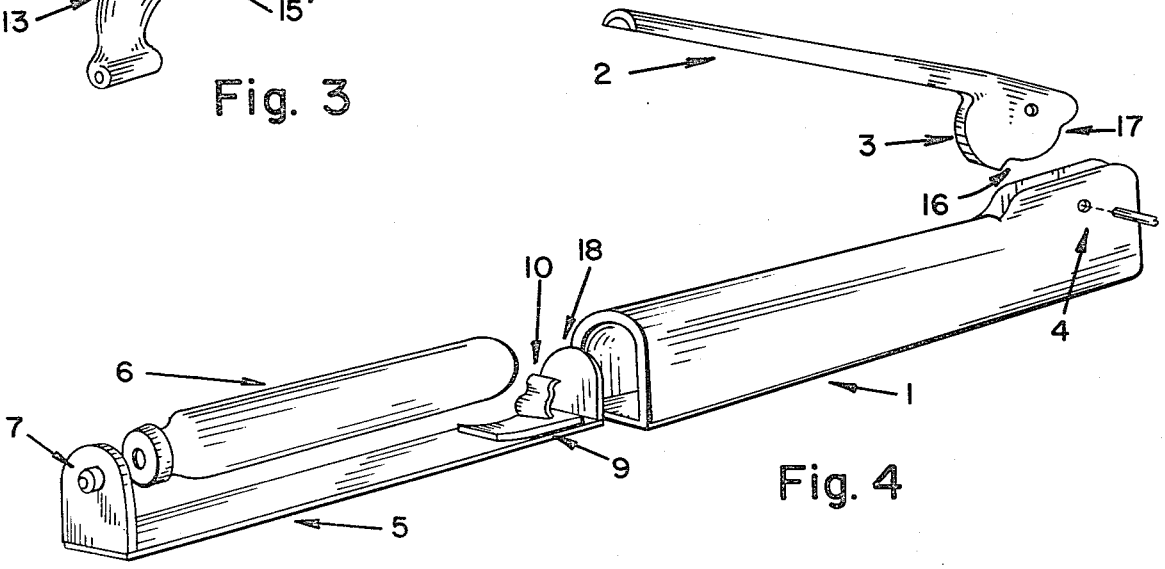
FIG. 4 shows the dispensing mechanism with cartridge frame 5 removed through the front of housing 1. Pressurized chemical cartridge 6 is shown with its pressure release valve lined up with discharge nozzle 7 of the frame. Cartridge carrying frame pusher spring 9 and vertical locating spring 10 are shown attached to frame 5.
Figure 5A:
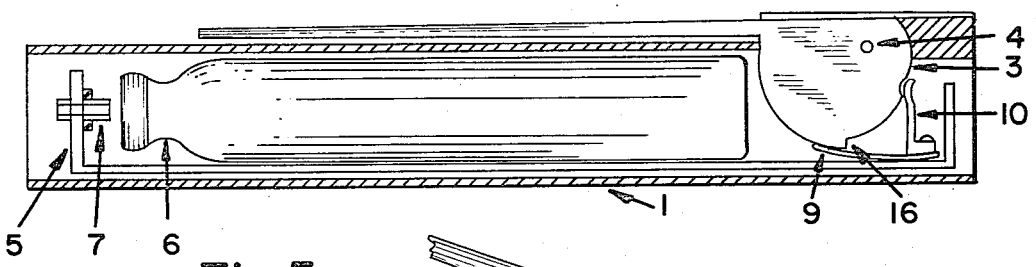
FIGS. 5*a*–5*e* show a series of cross-sectional views of the mechanism in different operating stages.
Figure 5B:
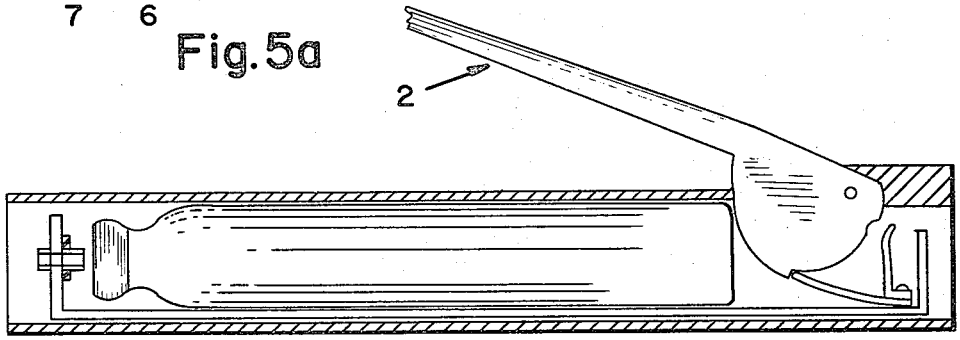
Figure 5C:
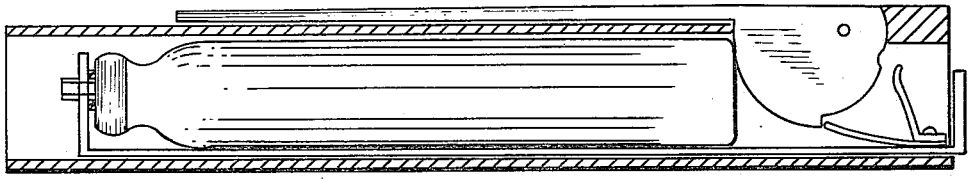
Figure 5D:
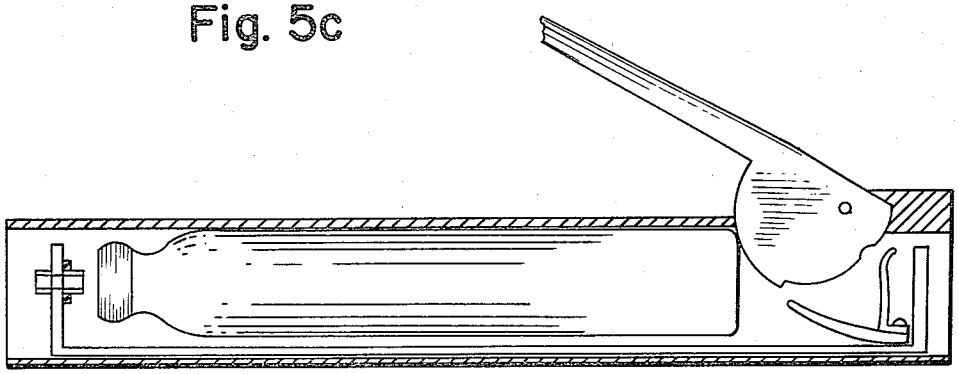
Figure 5E:
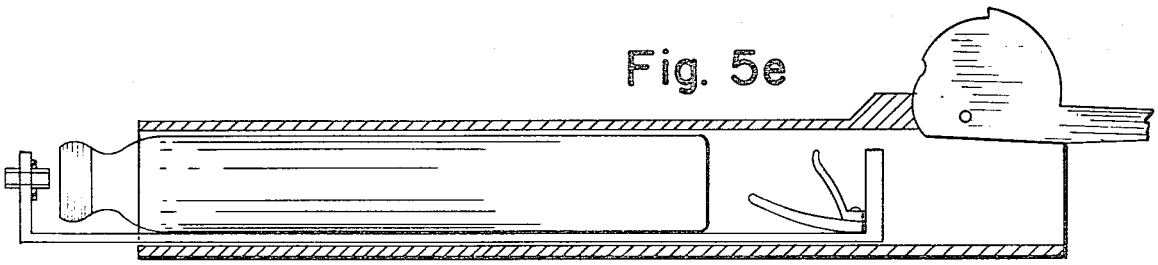

5. Cam lever swung rearward allowing cam profile to clear cartridge frame vertical spring 10. Cartridge frame is now released for removal from front of housing for replacement of cartridge. One of a number of possible means for detachably securing said device to other objects is shown in FIG. 3. In this example a grooved track 8 is furnished, permanently secured to the base of the device to accommodate a companion member 8A to be mounted on the object to which attachment is desired or to accomodate a similar companion member mounted upon an intermediary carrier 13 equipped with suitable attachment means 15 for use with casual objects not prepared with accomodating attachment means.

The foregoing is considered illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention as claimed.

What is claimed is as follows:

1. A hand held holder for pressurized chemical cartridges comprising in combination: a holder having a casing, a longitudinally movable frame within said casing for retaining a pressurized cartridge, an axle borne cam with operating lever as extension swinging in a plane parallel to the long axis of the holder to move said frame rearward by engaging a flat pusher spring secured to said frame, a discharge nozzle mounted on said frame to contact and activate the release valve of the cartridge to discharge at least a part of its fluid under pressure outwardly of said unit in response to rearward movement of the frame, said holder having means for detachably securing to certain other compatible objects, and in which the operating cam is so notched and shaped on its periphery that engagement of said notch with said pusher spring is prevented while said cam is in the inoperative safety position, said notch to allow engagement with said pusher spring when the cam operating lever is raised from the inoperative safety position and to move said frame rearward by force against said spring as the cam moves through its operating rotation, said rearward moving frame forcing its discharge nozzle against the cartridge valve while the non-valve end of said chemical cartridge contacts the forward edge of said cam which being of a constant radius from its pivot restrains said cartridge from rearward motion, said cartridge carrying frame having a rear area available for pushing said frame forward within the housing causing the cam notch to swing forward and upward allowing said pusher spring to pass forward with the frame under and free of the notch to enable the operating lever to return to the inoperative safety position, said cam having an upper segment flattened parallel to the operating lever in sufficient proximity to its axle to allow, when rotated 180 degrees to the rear, clearance of a vertical frame positioning spring to remove the frame outwardly through the front of the housing.

2. The apparatus in accordance with claim 1 in which a vertical flat spring secured to the cartridge carrier frame bears against the rear periphery of the cam to restrain movement of the frame within the operational tolerance limitations, except when the cam is rotated upward and out of contact with said spring in order that the carrying frame be freed for removal through the front of the housing, said cam to have a rear surface so indented where it is in contact with the vertical frame restraining spring while in the inoperative safety position that it will restrict the cam lever from accidental movement upward into the operating position.

3. The apparatus in accordance with claim 1 incorporating securing means for detachably mating to other compatible objects furnished with companion mating means.

4. The apparatus in accordance with claim 1 incorporating securing means for detachably mating to an intermediary fixure equipped with adaptable attachment means for use with casual objects not designed with accommodating mating means.

5. A hand-held holder for pressurized chemical cartridges, comprising:

a casing having an opening therethrough between first and second ends of said casing;

a cartridge-carrying frame member dimensioned to slide through said opening of said casing, said frame member having first and second ends corresponding to said first and second ends of said casing when fitted therein;

a discharge nozzle at said first end of said frame member, said nozzle adapted to engage a discharge valve fitted to said cartridge for dispensing a pressurized chemical contained therein; and means at the second end of said casing and the second end of said frame for holding a cartridge carried by said frame in a relatively fixed position, while driving said frame through said casing toward said second end of said casing to cause movement of said nozzle toward and into engagement with said valve to effect the dispensing of the pressurized chemical contained therein.

6. The apparatus recited in claim 5 wherein said holding and driving means comprises a lever pivoted to the second end of said casing.

7. The apparatus recited in claim 6 wherein said lever comprises a cam surface adapted to engage said cartridge for holding said cartridge in said relatively fixed position.

8. The apparatus recited in claim 7 wherein said frame member comprises a flat pusher spring, said lever further comprising a notch along said cam surface whereby said flat pusher spring engages said lever in said notch, and whereby driving of said frame member through said opening is effected by first rotating said lever away from said casing until said flat pusher spring engages said notch, and thereafter rotating said lever toward said casing.

9. The apparatus recited in claim 7 wherein frame member comprises a vertical locating spring, said lever including a notch along said cam surface, said locating spring engageable in said notch when said lever lies along the outer surface of said casing.

10. The apparatus recited in claim 5 further comprising means for coupling said casing to a disparate article.

11. A hand-held holder for pressurized chemical cartridges, comprising:

a casing having an opening therethrough between first and second ends of said casing;

a frame member dimensioned to slide through said opening of said casing, said frame member adapted to hold a pressurized chemical cartridge in said opening;

a pressurized chemical cartridge positioned in said frame member, said cartridge having a discharge valve at the first end of said frame member;

a discharge nozzle at said first end of said frame member, said nozzle positioned adjacent said discharge valve of said cartridge and adapted to engage said valve for dispensing a pressurized chemical contained therein; and means for engaging the end of said pressurized chemical cartridge opposite said first end and simultaneously engaging the second end of said frame member for holding said cartridge in a fixed position while moving said frame member through said opening relative to said cartridge and casing, to thereby effect engagement of said nozzle with said discharge valve of said cartridge, to dispense the ingredients of said cartridge.

12. The apparatus recited in claim 11 further comprising means for coupling said casing to a disparate article.

* * * * *